US011547157B2

(12) United States Patent
Stauffer et al.

(10) Patent No.: US 11,547,157 B2
(45) Date of Patent: Jan. 10, 2023

(54) GARMENT, IN PARTICULAR A SPORTS GARMENT

(71) Applicant: Edouard Stauffer, Versoix (CH)

(72) Inventors: Edouard Stauffer, Versoix (CH); Jacques Aymon, Bernex (CH)

(73) Assignee: Edouard Stauffer, Versoix (CH)

( * ) Notice: Subject to any disclaimer, the term of this patent is extended or adjusted under 35 U.S.C. 154(b) by 133 days.

(21) Appl. No.: 16/474,602

(22) PCT Filed: Dec. 29, 2016

(86) PCT No.: PCT/IB2016/058075
§ 371 (c)(1),
(2) Date: Jun. 28, 2019

(87) PCT Pub. No.: WO2018/122578
PCT Pub. Date: Jul. 5, 2018

(65) Prior Publication Data
US 2019/0320745 A1 Oct. 24, 2019

(51) Int. Cl.
*A41D 13/00* (2006.01)
*A41D 1/04* (2006.01)
*A41D 27/24* (2006.01)

(52) U.S. Cl.
CPC ..... *A41D 13/0015* (2013.01); *A41D 1/04* (2013.01); *A41D 27/24* (2013.01); *A41D 2600/10* (2013.01)

(58) Field of Classification Search
CPC ..... A41D 27/24; A41D 1/04; A41D 13/0015; A41D 2600/10; A41D 2300/52; A41D 13/015
(Continued)

(56) References Cited

U.S. PATENT DOCUMENTS 4,573,420 A * 3/1986 Carson ..... D05B 35/02 112/142
2010/0192276 A1* 8/2010 Anderson ..... A41D 13/0015 2/115

(Continued)

FOREIGN PATENT DOCUMENTS

CN 105764368 A 7/2016
DE 29814273 U1 11/1998

(Continued)

OTHER PUBLICATIONS

Translation DE29814273U1 (Year: 1998).*

(Continued)

*Primary Examiner* — Alissa L Hoey
*Assistant Examiner* — Catherine M Ferreira
(74) *Attorney, Agent, or Firm* — Nixon & Vanderhye

(57) ABSTRACT

Disclosed is a garment, particularly a sports garment, including at least two pieces of fabric assembled to each other by a first weak seam arranged so as to give in the event of traction applied to one of the pieces of fabric so as to allow the separation of the pieces. The at least two pieces of fabric are also assembled by at least one second seam, called a strong seam, which is more solid than the first seam and arranged so as not to give in the event of traction applied to one of the pieces of fabric, and so as to become completely undone by pulling on one of the threads forming the seam so that it no longer joins the at least two pieces of fabric.

20 Claims, 2 Drawing Sheets

(58) Field of Classification Search
USPC ..... 2/69
See application file for complete search history.

(56) References Cited

U.S. PATENT DOCUMENTS

| | | | | |
|---|---|---|---|---|
| 2015/0167230 | A1* | 6/2015 | Russell | D06H 7/221<br>241/23 |
| 2017/0027247 | A1* | 2/2017 | Lim | A41D 31/0005 |

FOREIGN PATENT DOCUMENTS

| | | | | |
|---|---|---|---|---|
| DE | 29922214 | U1 | 4/2000 | |
| DE | 19901774 | A1 | 7/2000 | |
| DE | 10048149 | A1 | 4/2002 | |
| DE | 102011055321 | A1 | 5/2013 | |
| EP | 2 857 564 | A2 | 4/2015 | |
| GR | 20160100405 | A * | 7/2016 | A41D 13/00 |

OTHER PUBLICATIONS

Translation DE102011055321A1 (Year: 2013).*
Translation DE29922214U1 (Year: 2000).*
Translation DE19901774A1 (Year: 2000).*
DE10048149A1 (Year: 2002).*
GR 20160100405 A—Description—Translation—Parissinos—Jul. 2016.*
International Search Report, dated Mar. 29, 2017, from corresponding PCT application No. PCT/IB2016/058075.
Office Action issued in Chinese Patent Application No. 201680091922.5 dated Jul. 3, 2020 with English translation provided.

* cited by examiner

GARMENT, IN PARTICULAR A SPORTS GARMENT

BACKGROUND OF THE INVENTION

Field of the Invention

The present invention relates to a garment, and in particular a sports garment, such as a shirt.

Description of the Related Art

In playing some sports, in particular in football, some fouls are hard for the referee to see and sometimes go unpenalised because they are often denied by the players accused of having committed them or because they have already stopped before the referee notices them. This is especially the case with shirt-pulling which is prohibited in most team sports and is severely penalised because it disrupts the game, but it is very difficult to prove and easy to deny unless someone has been caught in the act.

Several prior art documents such as DE 199 01 774 and DE 100 48 149 have proposed a tearable sports garment making it possible to prove a shirt-pulling-type foul: the garment has at least one tearable portion which, when illegally pulled by a player, tears and remains in the hand of the offending player. The referee can thus easily penalise the foul since the player no longer really has a means of escaping punishment.

Although the tearable sports garments proposed in the prior art all make it possible to prove a shirt-pulling-type foul they still have the disadvantage of being fragile including when the player or sportsman is putting on the garment before any activity or sports match. Some have solved this problem by using mechanical fastening systems with textile hooks and loops (known by the trademark VELCRO®). Although such systems ensure the possible reuse of the tearable garment and that it is easier to put on because it is merely necessary to reattach a detached part, they are still bulky and tend to make the garment heavy and cause it to lose flexibility and comfort. In most team sports, modern sports garments are formed by a thin layer worn very close to the body.

SUMMARY OF THE INVENTION

The aim of the present invention is thus to create a sports garment which makes it possible to prove fouls of the "shirt-pulling" or "garment-pulling" type, in particular for use in playing team sports such as football, and which obviates the above-mentioned disadvantages. In particular, the present invention relates to the creation of a sports garment which is easy to put on without the risk of damaging it, while remaining comfortable, flexible and light like a modern high-level sports garment.

The present invention relates to a garment, in particular a sports garment.

BRIEF DESCRIPTION OF THE DRAWINGS

The attached figures schematically illustrate an embodiment of the sports garment in accordance with the invention, in which.

DESCRIPTION OF THE PREFERRED EMBODIMENTS

In the illustrated embodiment, the sports garment in accordance with the invention is a shirt 1 (t-shirt with short sleeves) used by players in team sports such as football. As a variation, the invention relates to any sports garment (shorts, trousers, jacket, vest, bib, t-shirt, pullover, long-sleeved top, short-sleeved top, sleeveless top . . . ).

The shirt 1 is preferably formed from eight pieces of fabric E1 to E8. The fabric can be any suitable fabric: natural or synthetic, recyclable, elastic . . . . These pieces of fabric E1 to E8 are sewn together to form the shirt 1. In the illustrated embodiment, the pieces E1 and E3 form the sleeves, the pieces E2, E4 and E5 form the front face of the shirt 1, while the pieces E6, E7 and E8 form the rear face of the shirt 1.

These pieces of fabric E1 to E8 are attached to each other using a weak seam 2 which has the feature of being weak and of low strength in order to permit the pieces of fabric E1 to E8 to separate/detach from each other if one of these pieces is pulled and in particular if subjected to pulling of the "shirt-pulling" type which would take place when playing a team sport. In the case of a shirt 1 used for football, the weak seam 2 preferably allows normal playing of this sport but gives way when abnormal pulling (pulling with a first force) is exerted on the shirt 1 such as when an opposing player attempts to impede the wearer of the shirt.

Figures 3, 4:
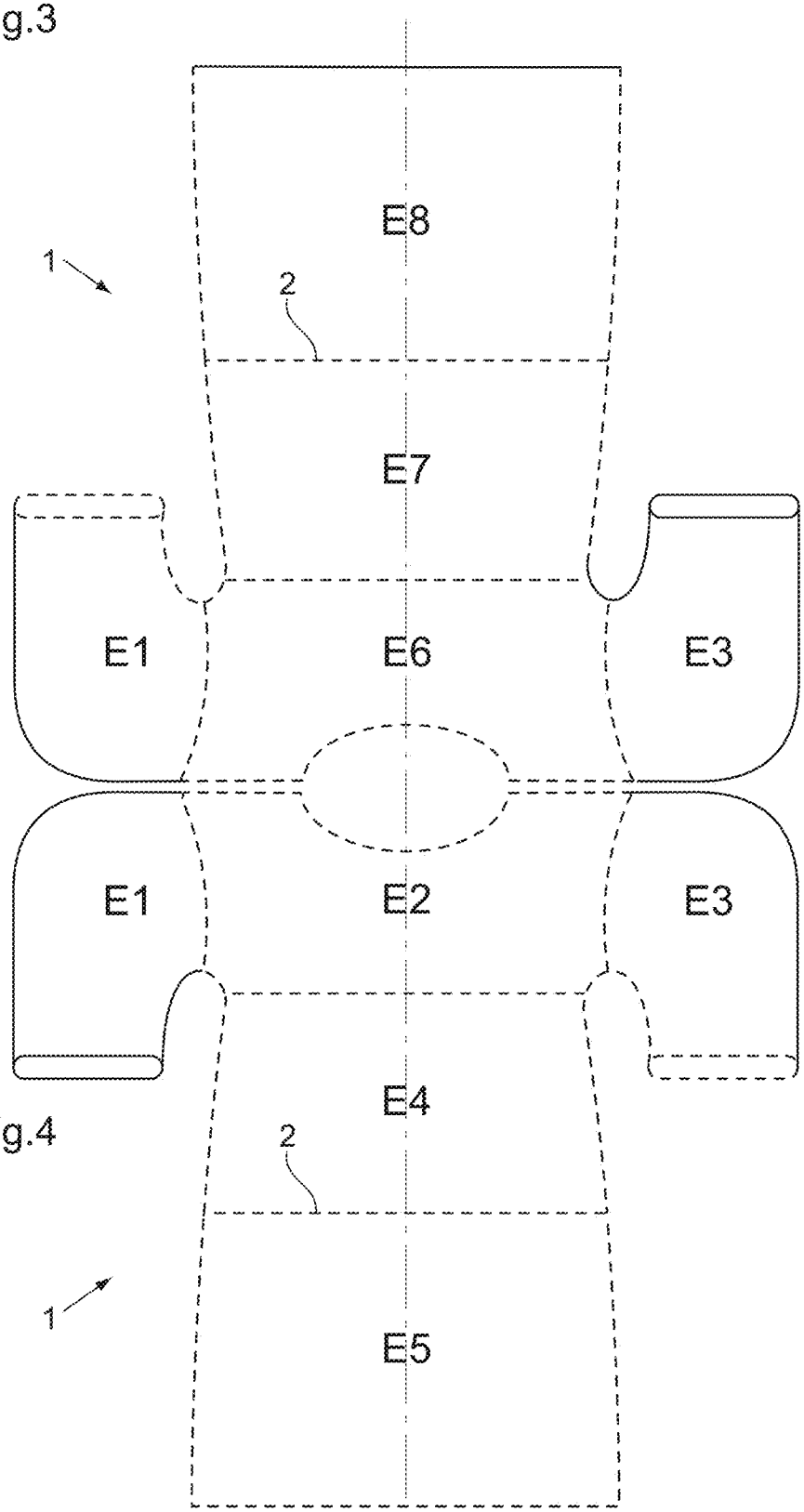

This weak seam 2 and its path are particularly illustrated in FIGS. 3 and 4. For example, this weak seam 2 can be produced using a weak thread such as a basting thread, also called tacking thread (in general 20 Tex or 20 g per 1000 metres). This weak seam 2 can also be characterised by a weak stitch not generally suitable for the final assembly of pieces of fabric such as a straight stich and/or a long stitch length.

According to the particular feature of the invention, the pieces of fabric E1 to E8 are also attached together using "strong" seams 31 to 36. For their part, these strong seams 31 to 36 are robust, i.e., they do not permit tearing or separation of the pieces of fabric which they attach together if subjected to pulling with the first force. On the other hand, these strong seams 31 to 36 are arranged to be undone and unravelled entirely by a pull on one of the treads of which they are formed (in the manner of a knitting stitch which unravels when a thread is pulled). In practice, these strong seams 31 to 36 do not comprise a stop (by a stitch or a reversal) at their ends. These strong seams 31 to 36 are preferably produced by a hem stitch with a normal strength polyester thread (60 Tex) or an extra strong polyester thread (150 Tex) or even buttonhole thread (105 Tex).

Figures 1, 2:
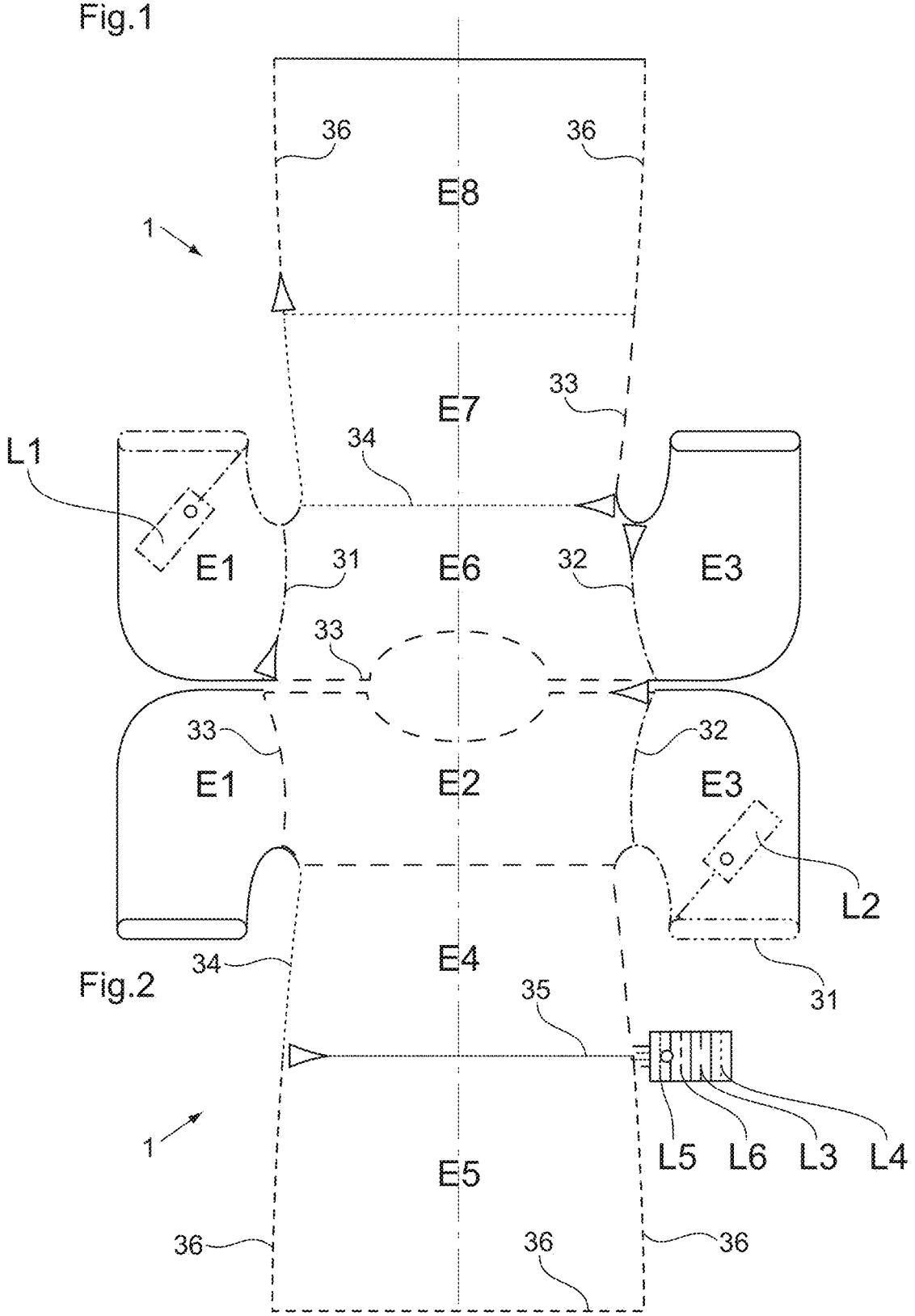
FIGS. 1 and 3 illustrate a sports garment in accordance with the invention seen from the back.
FIGS. 2 and 4 illustrate a sports garment in accordance with the invention seen from the front.

In order to clearly show the invention, the strong seams 31-36 are shown in FIGS. 1-2, whereas the weak seams 2 are shown in FIGS. 3-4.

In the illustrated embodiment, the eight pieces of fabric E1 to E8 are thus attached to each other by the weak seam 2 to form the shirt 1. The pieces of fabric E1 to E8 are then also attached together using strong seams 31 to 36 in the following manner:

a first strong seam 31 follows the contour of the first piece of fabric E1 (first sleeve of the shirt 1) and attaches it to the piece E6;

a second strong seam 32 follows the contour of the third piece of fabric E3 (second sleeve of the shirt 1) and attaches it to the pieces E2 and E6;

a third strong seam 33 attaches the pieces E2 to E6, E2 to E4, E4 to E7 and E2 to E1, a fourth strong seam 34 attaches the pieces E7 to E6, E7 to E4 and E7 to E8, a fifth strong seam 35 attaches the piece E5 to E4, a sixth strong seam 36 attaches the piece E5 to E8.

As indicated above, these strong seams 31 to 36 are arranged to be undone and unravelled entirely by a pull on one of the threads of which they are formed. Thus each of these first through sixth strong seams 31 to 36 has a first end, indicated by an arrow (triangle shape) in FIGS. 1 and 2 without a stopping point or reversal, in order to be able to be undone entirely. Each of these first through sixth strong seams 31 to also has a second end from which protrudes at least one thread of which it is composed and which makes it possible to undo said seam if said thread is pulled. For each of the first through sixth strong threads 31 to 36 said tread is long enough to allow the user to grip it and pull it. Said thread is preferably connected to a tab L1 to L6 making possible to identify it without difficulty and to grasp it easily. Also preferably, and as shown in FIGS. 1 and 2, the threads of the third through sixth strong seams 33, 34, 35 and 36 meet in a single tab. Consequently, a pull on said tab pulls at least one thread of the third through sixth strong seams 33, 34, 35 and 36 so as to undo them simultaneously.

Thus, before any use, the shirt 1 in accordance with the invention is formed of at least two pieces of fabric E1 to E8 which are attached together using the weak seam 2 and at least one strong seam 31 to 36. At this stage, a pull on one of the pieces of fabric E1 to E8 will not cause detachment thereof since the strong seams 31 to 36 are robust and in particular resistant to the pull at the first force.

In particular, a player or user can put on the shirt 1 by pulling on it—e.g. on the bottom and the sleeves—in order to adjust it without the risk of tearing one of the pieces of fabric E1 to E8 of which it is formed.

Once the shirt 1 is put on and the player is ready to play he/she grips each of the tabs L1 to L6 and undoes the first through sixth strong seams 31 to 36 one by one. In the illustrated example, the player grips the tab L1 in order to undo the first strong seam 31, the tab L2 to undo the second strong seam 32 and the single tab L3 to L6 to simultaneously undo the first through sixth strong seams 33 to 36. Once the first through sixth strong seams 31 to 36 are entirely undone the player is then wearing a "tearable" shirt 1 of which the pieces of fabric E1 to E8 forming it are then attached to each other only by the weak seam 2 which is weak and not resistant to pulling (see FIGS. 3 and 4). Thus if an opposing player pulls on the shirt 1 in order to stop or impede its wearer the weak seam 2 will give way owing to its low strength and one or more of the pieces of fabric E1 to E8 will be detached from the shirt 1: the wearer of the shirt 1 is not hindered, play can continue and it will be very difficult or impossible for the offending player to escape punishment.

Thus a sports garment is produced making it possible to prove fouls of the "shirt-pulling" type, in particular for use in playing team sports such as football. In particular, the garment in accordance with the present invention is easy to put on, without risk of damaging it, while remaining comfortable, flexible and light like a modern high-level sports garment.

The sports garment and the pieces of fabric thereof can be produced of any suitable fabric, synthetic, recyclable or natural, elastic or non-elastic . . . . In the same way, the threads used for the first seam and the strong seam can be of any suitable type, polyester, cotton, braided . . . .

Finally, it will be noted that the garment in accordance with the invention could also be used as a safety garment: strong enough to be put on by reason of the first through sixth strong seams but tearable by reason of the low strength of the weak seam when said strong seams have been undone and one of the pieces of fabric of which it is formed gets caught in a machine or the wearer must take the garment off quickly (chemical contamination).

The invention claimed is:

1. A garment comprising:

at least two pieces of fabric, wherein a first piece of the at least two pieces of fabric is attached to a second piece of the at least two pieces of fabric along a first seamline;

a weak seam that attaches the first and second pieces of the at least two pieces of fabric to each other along the first seam line, the weak seam being arranged to give way in an event of pulling with a first force on one of the first and second pieces of the at least two pieces of fabric in order to permit separation of the first and second pieces of the at least two pieces of fabric from each other; and a strong seam that attaches said first and second pieces of the at least two pieces of fabric to each other along the first seam line, the strong seam being formed of threads, the strong seam being arranged not to give way in the event of pulling with the first force on one of the first and second pieces of the at least two pieces of fabric, wherein the weak seam and strong seam are coextensive along the first seam line and each attaches said first and second pieces of the at least two pieces of fabric together along the first seam line, wherein the strong seam is entirely undone and removed from the first seam line by a user pulling on one of the threads, of which the strong seam is formed, so that the strong seam no longer connects said first and second pieces of the at least two pieces of fabric to each other while the weak seam continues to attach the first and second pieces of the at least two pieces of fabric to each other along the first seam line, so that, with the strong seam no longer connecting said first and second pieces of the at least two pieces of fabric to each other along the first seam line and with the weak seam continuing to attach the first and second pieces of the at least two pieces of fabric to each other along the first seam line, the event of pulling with the first force on one of the first and second pieces of at least two pieces of fabric permits separation of the first and second pieces of at least two pieces of fabric from each other along the first seam line by the weak seam giving way under the first force.

2. The garment as claimed in claim 1, further comprising at least one tab which is connected at an end of at least one of the threads forming the strong seam, the at least one tab providing an identification, wherein pulling on the at least one tab pulls on said at least one of the threads forming the strong seam and thereby causes the strong seam to become entirely undone so that the strong seam no longer connects said first and second pieces of the at least two pieces of fabric to each other along the first seam line and the weak seam continues to connect said first and second pieces of the at least two pieces of fabric to each other along the first seam line.

3. The garment as claimed in claim 1, wherein the weak seam is formed using basting thread.

4. The garment as claimed in claim 1, wherein the strong seam is formed using buttonhole thread.

5. The garment as claimed in claim 1, wherein the garment is a sports shirt.

6. The garment as claimed in claim 2, wherein the weak seam is formed using basting thread.

7. The garment as claimed in claim 2, wherein the strong seam is formed using buttonhole thread.

8. The garment as claimed in claim 3, wherein the strong seam is formed using buttonhole thread.

9. The garment as claimed in claim 6, wherein the strong seam is formed using buttonhole thread.

10. The garment as claimed in claim 2, wherein the garment is a sports shirt.

11. The garment as claimed in claim 3, wherein the garment is a sports shirt.

12. The garment as claimed in claim 4, wherein the garment is a sports shirt.

13. The garment as claimed in claim 6, wherein the garment is a sports shirt.

14. The garment as claimed in claim 7, wherein the garment is a sports shirt.

15. The garment as claimed in claim 8, wherein the garment is a sports shirt.

16. The garment as claimed in claim 9, wherein the garment is a sports shirt.

17. The garment as claimed in claim 1, wherein, the at least two pieces of fabric includes a third fabric piece, the garment includes plural of the weak seam, the garment includes plural of the strong seam, the garment includes plural seam lines in addition to the first seam line, a first one of weak seams attaches a first portion of a contour of the first fabric piece to a first portion of a contour of the second piece of fabric by following the first portion of the contour of the first fabric piece and following the first portion of the contour of the second fabric piece along a first one of the first seam lines, a first one of strong seams attaches the first portion of the contour of the first fabric piece to the first portion of the contour of the second fabric piece by following the first portion of the contour of the first fabric piece and following the first portion of the contour of the second fabric piece along the first one of first seam lines, the first one of the weak seams and the first one of the strong seams are coextensive along the first one of first seam lines and attach the first portion of the contour of the first fabric piece to the first portion of the contour of the second fabric piece along the first one of the first seam lines, a second one of weak seams attaches a second portion of the contour of the second fabric piece to a first portion of a contour of the third fabric piece by following the second portion of the contour of the first fabric piece and following the first portion of the contour of the third fabric piece along a second one of the first seam lines, a second one of strong seams attaches the second portion of the contour of the first fabric piece to the first portion of the contour of the third fabric piece by following the second portion of the contour of the first fabric piece and following the first portion of the contour of the third fabric piece along the second one of first seam lines, and the second one of the weak seams and the second one of the strong seams are coextensive along the second one of first seam lines and attach the second portion of the contour of the first fabric piece to the first portion of the contour of the third fabric piece along the second one of the seam lines.

18. The garment as claimed in claim 2, wherein, the at least two pieces of fabric includes a third fabric piece, the garment includes plural of the weak seam, the garment includes plural of the strong seam, the garment includes plural seam lines in addition to the first seam line, a first one of weak seams attaches a first portion of a contour of the first fabric piece to a first portion of a contour of the second piece of fabric by following the first portion of the contour of the first fabric piece and following the first portion of the contour of the second fabric piece along a first one of the first seam lines, a first one of strong seams attaches the first portion of the contour of the first fabric piece to the first portion of the contour of the second fabric piece by following the first portion of the contour of the first fabric piece and following the first portion of the contour of the second fabric piece along the first one of first seam lines, the first one of the weak seams and the first one of the strong seams are coextensive along the first one of first seam lines and attach the first portion of the contour of the first fabric piece to the first portion of the contour of the second fabric piece along the first one of the first seam lines, a second one of weak seams attaches a second portion of the contour of the second fabric piece to a first portion of a contour of the third fabric piece by following the second portion of the contour of the first fabric piece and following the first portion of the contour of the third fabric piece along a second one of the first seam lines, a second one of strong seams attaches the second portion of the contour of the first fabric piece to the first portion of the contour of the third fabric piece by following the second portion of the contour of the first fabric piece and following the first portion of the contour of the third fabric piece along the second one of first seam lines, and the second one of the weak seams and the second one of the strong seams are coextensive along the second one of first seam lines and attach the second portion of the contour of the first fabric piece to the first portion of the contour of the third fabric piece along the second one of the first seam lines.

19. The garment as claimed in claim 2, wherein the strong seam has a first end that does not comprise any stop, including not comprising a stitch or a reversal, wherein the strong seam has a second end with the at least one tab, the at least one tab configured to be gripped and pulled by a user to undo the strong seam and remove the threads of the strong seam from the first seam line so that the strong seam no longer attaches the first piece of fabric to the second piece of fabric.

20. A sports shirt comprising: a first piece of fabric; a second piece of fabric; a weak seam that attaches a lower edge of the first piece of fabric to an upper edge of the second piece of fabric to thereby attach the first and second pieces of fabric to each other along a first seam line; a strong seam that attaches the lower edge of the first piece of fabric to the upper edge of the second piece of fabric to thereby attach the first and second pieces of fabric to each other along the first seam line, wherein the weak seam and strong seam both extend along the first seam line and each attach the first and second pieces of fabric together along the first seam line, wherein the weak seam is weaker than the strong seam, such that in an event of pulling with a first force on the second piece of fabric with only the weak seam attaching the lower edge of the first piece of fabric to the upper edge of the second piece of fabric, the weak seam gives way and the upper edge of the second piece of fabric separates from the lower edge of the first piece of fabric wherein the strong seam is stronger than the weak seam such that in the event of pulling with the first force on the second piece of fabric with only the strong seam attaching the lower edge of the first piece of fabric to the upper edge of the second piece of fabric the strong seam does not give way and the upper edge of the second piece of fabric does not separate from the lower edge of the first piece of fabric wherein the strong seam is formed of threads, wherein the strong seam has a first end that does not comprise any stop, including not comprising a stitch or a reversal, wherein the strong seam has a second end with a protrusion configured to be gripped and pulled by a user to undo the strong seam and remove the threads of the strong seam from the first seam line so that the strong seam no longer attaches the lower edge of the first piece of fabric to the upper edge of the second piece of fabric and wherein, with the strong seam undone and the threads of the strong seam removed from the first seam line, the weak seam continues to attach the lower edge of the first piece of fabric to the upper edge of the second piece of fabric to thereby attach the first and second pieces of fabric to each other along the first seam line, and the event of pulling with the first force on the second piece of fabric with only the weak seam attaching the lower edge of the first piece of fabric to the upper edge of the second piece of fabric the weak seam gives way and the upper edge of the second piece of fabric separates from the lower edge of the first piece of fabric thereby separating the first and second pieces of fabric from each other.

* * * * *